US006427056B1

(12) United States Patent
Kawano et al.

(10) Patent No.: US 6,427,056 B1
(45) Date of Patent: Jul. 30, 2002

(54) IMAGE FORMING APPARATUS HAVING A FIXING DEVICE FOR FIXING DEVELOPER IMAGE ON RECORDING MEDIUM BY SUBJECTING HEAT ROLLER TO INDUCTION HEATING

(75) Inventors: Hisaaki Kawano, Chigasaki; Hiroshi Nakayama, Kawasaki; Kenji Takano; Taizo Kimoto, both of Tokyo; Noriyuki Umezawa, Yokohama; Osamu Takagi; Satoshi Kinouchi, both of Tokyo; Kazuhiko Kikuchi; Masahiko Ogura, both of Yokohama, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/939,576

(22) Filed: Aug. 28, 2001

Related U.S. Application Data

(63) Continuation of application No. PCT/JP99/07407, filed on Dec. 28, 1999.

(51) Int. Cl.[7] ..... G03G 15/00; G03G 15/20

(52) U.S. Cl. ..... 399/67; 399/11; 399/82

(58) Field of Search ..... 399/67, 69, 70, 399/11, 18, 33, 37, 75, 320, 328, 88, 82; 219/216, 619; 430/124

(56) References Cited

U.S. PATENT DOCUMENTS

| | | | | |
|---|---|---|---|---|
| 5,526,103 A | | 6/1996 | Kato et al. | 399/328 |
| 5,640,646 A | | 6/1997 | Toyohara et al. | 399/69 |
| 5,878,301 A | * | 3/1999 | Katakura et al. | 399/67 |
| 6,101,346 A | * | 8/2000 | Arakawa | 399/70 |

FOREIGN PATENT DOCUMENTS

| | | |
|---|---|---|
| JP | 2-199494 | 8/1990 |
| JP | 7-248706 | 9/1995 |
| JP | 7-319312 | 12/1995 |

* cited by examiner

*Primary Examiner*—Sophia S. Chen
(74) *Attorney, Agent, or Firm*—Foley & Lardner

(57) ABSTRACT

The present invention includes individually (independently) a drive control section for driving/controlling an induction heating device of a fixing device and a main-body control section for entirely controlling an electronic copying machine. The start-up processing for the induction heating device is started prior to start-up processing for parts of the main body of the electronic copying machine other than the induction heating device.

1 Claim, 7 Drawing Sheets

IMAGE FORMING APPARATUS HAVING A FIXING DEVICE FOR FIXING DEVELOPER IMAGE ON RECORDING MEDIUM BY SUBJECTING HEAT ROLLER TO INDUCTION HEATING

CROSS-REFERENCE TO RELATED APPLICATIONS

This is a Continuation Application of PCT Application No. PCT/JP99/07407, filed Dec. 28, 1999, which was not published under PCT Article 21(2) in English.

BACKGROUND OF THE INVENTION

1. Field of the Invention

The present invention relates to an image forming apparatus in which a high-frequency magnetic field is generated from a coil and is applied to a heat generation member to cause the heat generation member to generate eddy currents, and a developer image on a recording medium is fixed by self-heat-generation of the heat generation member based on loss of the eddy currents.

2. Description of the Related Art

In an image forming apparatus which is a so-called electronic copying machine using digital technology, an original document table on which an original document is set is exposed to light, to obtain image signals corresponding to amounts of reflected light from the original document table by means of a line sensor of a CCD (Charge-Couple Device) type, and laser light corresponding to the obtained image signals is irradiated on a photosensitive drum, to form an electrostatic latent image on the circumferential surface of the photosensitive drum. The electrostatic latent image is developed by sticking a developer agent (toner) previously changed (to negative) polarity. A paper sheet is fed at a timing in compliance with the rotation of the photosensitive drum, and the developed image (developer image) on the photosensitive drum is transferred to the sheet. The paper sheet to which the developer image has been thus transferred is further fed to a fixing device.

The fixing device comprises a heat roller and a press roller in contact with the heat roller. A paper sheet is inserted between both rollers. The developer image on the paper sheet is fixed by the heat of the heat roller while conveying the paper sheet.

An example of a heat source for the heat roller is an induction heating device. The induction heating device comprises a coil contained inside the heat roller, and a high-frequency generation circuit which supplies the coil with a high-frequency current.

The high-frequency generation circuit comprises a rectifier circuit for rectifying the voltage of an alternative power source, a switching circuit for converting an output voltage (direct current voltage) of the rectifier circuit into a high frequency wave having a predetermined frequency. The coil is connected to an output end (the output end of the switching circuit) of the high-frequency generation circuit.

When the high-frequency generation circuit operates, the coil is supplied with a high-frequency current, so that a high-frequency magnetic field is generated from the coil. This high-frequency magnetic field is applied to the heat roller, so that eddy currents are generated from the heat roller. Further, the heat roller autonomously generates heat, based on the loss of the eddy currents, and the developer image on the paper sheet is fixed by the generated heat.

In the electronic copying machine described above, however, when start-up processing is executed at the time of turning-on of the power, starting -of the induction heating device takes longer than the other parts.

It is conventionally arranged such that start-up of the induction heating device is started after the other parts have been started-up.

Therefore, there is a problem that warm-up takes a long time.

BRIEF SUMMARY OF THE INVENTION

The present invention has been made in consideration of the above situation and has an object of shortening the warm-up time.

An image forming apparatus according to the present invention has a fixing device which includes a coil in a heat roller and lets the heat roller generate a high-frequency magnetic field thereby to generate eddy currents from the heat roller, and which fixes a developer image on to a recording medium by autonomous heat generation of the heat roller, based on eddy current loss, comprising: drive means for driving the fixing device; and execution means for executing, preceding start-up processing, to start drive of the fixing device by the drive means prior to other parts.

An image forming apparatus according to the present invention has a fixing device which includes a coil in a heat roller and lets the heat roller generate a high-frequency magnetic field thereby to generate eddy currents from the heat roller, and which fixes a developer image on to a recording medium by autonomous heat generation of the heat roller, based on eddy current loss, comprising: drive means for driving the fixing device; execution means for executing preceding start-up processing, to start drive of the fixing device by the drive means prior to other parts; determination means for determining an abnormality of the fixing device; and stop means for stopping the preceding start-up processing by the execution means, when an abnormality of the fixing device is determined by the determination means.

An image forming apparatus according to the present invention has a fixing device which includes a coil in a heat roller and lets the heat roller generate a high-frequency magnetic field thereby to generate eddy currents from the heat roller, and which fixes a developer image onto a recording medium by autonomous heat generation of the heat roller, based on eddy current loss, characterized by comprising: drive means for driving the fixing device; execution means for executing preceding start-up processing, to start drive of the fixing device by the drive means prior to other parts; setting means for setting a service mode for performing maintenance on the image forming apparatus; and stop means for stopping the preceding start-up processing by the execution means, when the service mode is set by the setting means.

In an image forming apparatus according to the present invention, an image is formed on an image carrier, the image of the image carrier is developed with a developer agent, this developer image is transferred to a transfer medium, and thereafter, the developer image is fixed by a fixing device using induction heating, and the apparatus comprises: first control means for driving and controlling the fixing device which performs the fixing by the induction heating; and second control means for controlling the entire image forming apparatus, wherein the first control means and the second control means are provided independently from each other, and start of drive/control of the fixing device by the first control means and start of drive/control, by the second control means, of parts other than the fixing device are carried out in parallel at the time of turning on a power source.

In an image forming apparatus according to the present invention, an image is formed on an image carrier, the image of the image carrier is developed with a developer agent, this developed image is transferred to a transfer medium, and thereafter, the developed image is fixed by a fixing device using induction heating, and the apparatus comprises: first control means for driving and controlling the fixing device which performs the fixing by the induction heating; and second control means for controlling the entire image forming apparatus, wherein after drive/control of the fixing device by the first control means is started at a time of turning on a power source, drive/control of parts other than the fixing device is started by the second control means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

In the following, the first embodiment of the present invention will be explained.

Figure 1:
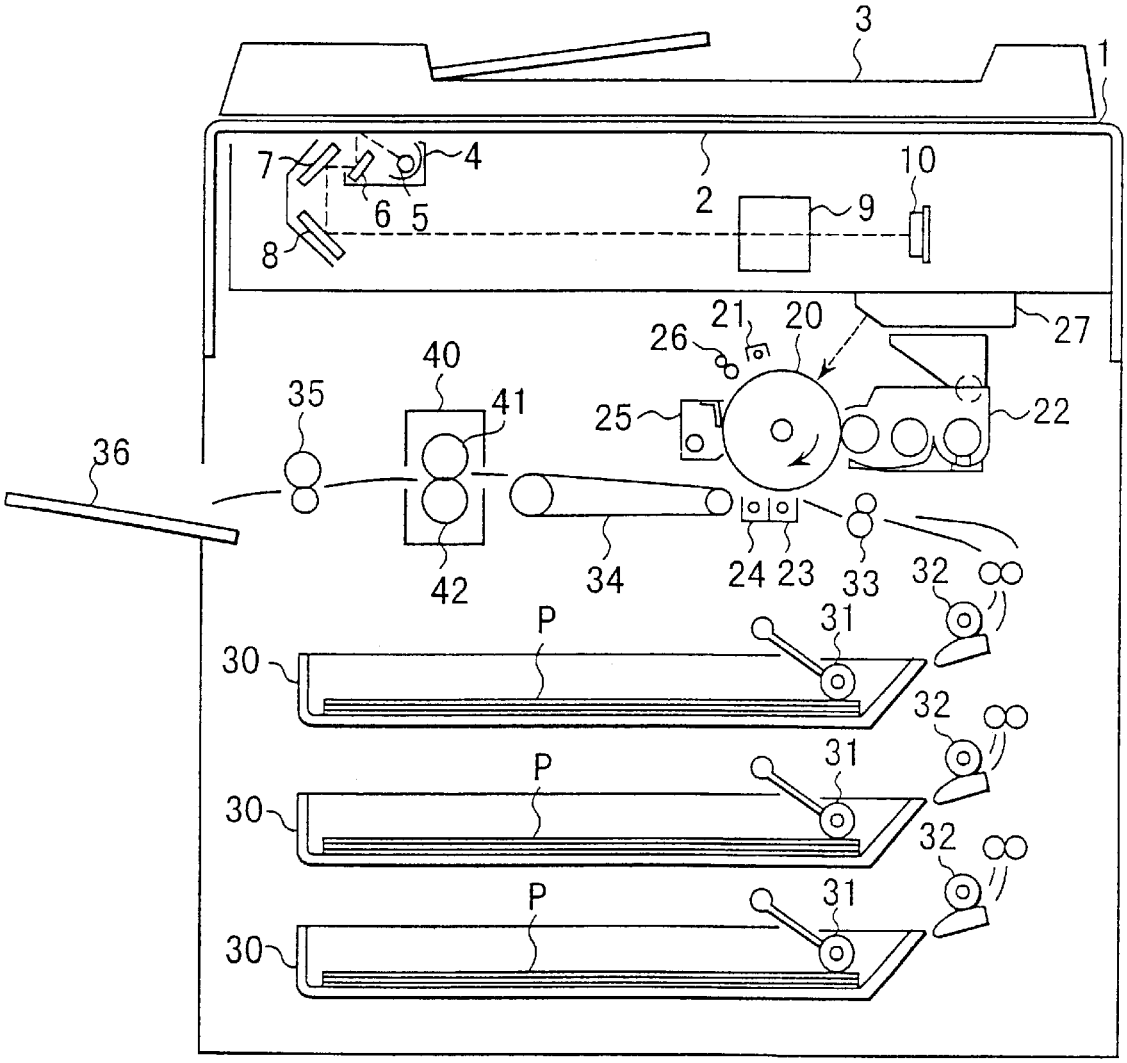
FIG. 1 is a view showing the entire structure of an electronic copying machine.

At first, FIG. 1 shows an example of the internal structure of an electronic copying machine.

An original document table 2 table is provided at an upper part of a main body 1, and an automatic document feeder 3 is provided above the original document table 2. The automatic document feeder 3 automatically feeds original documents, one after another, to the upper surface of the original document table 2.

A carriage 4 is provided to be reciprocally moved in the lower surface of the original document table 2. An exposure lamp 5 is provided on the carriage 4. The carriage 4 reciprocally moves with the exposure lamp 5 turned on, and thus, the entire surface of the original document table 2 is exposed and scanned.

By this exposure scanning, a reflected light image of the original document set on the original table is obtained, and the reflected light image is projected onto a CCD (Charge-Coupled Device) type line sensor 10 (hereinafter called a CCD sensor) via reflecting mirrors 6–8 and a lens block 9 for scaling.

A photosensitive drum 20 is rotatably provided in the main body 1. An electrification charger 21, a developing device 22, a transfer charger 23, a peeling charger 24, a cleaner 25, and a discharger 26 are provided sequentially in the periphery of the photosensitive drum 20. The laser beam emitted from the laser unit 27 passes between the electrification charger 21 and the developing device 22 and is irradiated onto the circumferential surface of the photosensitive drum 20.

A plurality of paper feed cassettes 30 are provided at the bottom of the main body 1. These paper feed cassettes 30 each contain a large number of copy paper sheets P.

Each paper feed cassette 30 is provided with a pickup roller 31 for picking up copy paper sheets P one after another. When copying is carried out, copy paper sheets are picked out one after another from any of the paper feed cassettes 30. Each picked-up copy paper sheet P is separated from the paper feed cassette 30 by a separator 32 and is fed to a resist roller 33 where the sheet waits for rotation of the photosensitive drum 20. The resist roller 33 feeds the copy paper sheet P between the transfer charger 23 and the photosensitive drum 20 at a timing matched with rotation of the photosensitive drum.

During copying, the photosensitive drum rotates in the clockwise direction shown in the figure. The electrification charger 21 applies a high voltage supplied from a high-voltage power source section (not shown), to the photosensitive drum 20, thereby to electrostatically charge the surface of the photosensitive drum 20. An electrostatic latent image is formed on the photosensitive drum 20, by the electrostatic charge and irradiation of a laser beam from the laser unit 27.

The developing device 22 supplies the photosensitive drum 20 with a developing agent. By thus supplying the developing agent, the electrostatic latent image on the photosensitive drum 20 is developed. The transfer charger 23 transfers the developed image (developer image) on the photosensitive drum 20, to a copy paper sheet P fed from the resist roller 33. The copy paper sheet on which the image has been transferred is peeled from the photosensitive drum 20 by the peeling charger 24. The peeled copy paper sheet P is fed to the fixing device 40 by a conveyor belt 34.

The fixing device 40 comprises a heat roller 41 and a press roller 42, and the developer image on the copy paper sheet P is fixed by the heat of the heat roller 41 while conveying the copy paper sheet P inserted between these rollers. The copying paper sheet P which has passed through the fixing device 40 is discharged onto a tray 36 by a conveyer roller 35.

Figure 2:
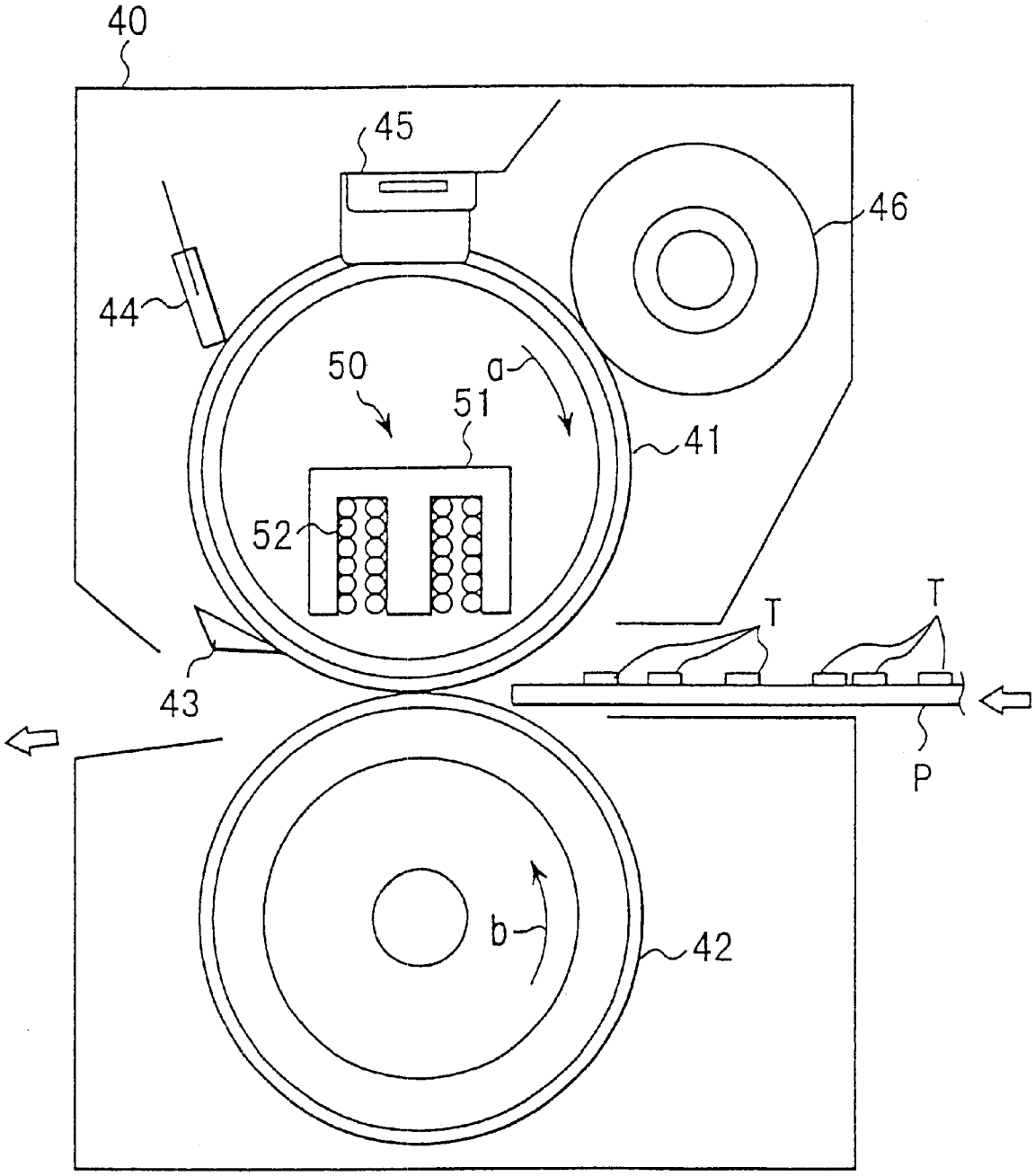
FIG. 2 is a view showing the structure of a fixing device.

FIG. 2 shows a specific structure of the fixing device 40.

The heat roller 41 which is electrically conductive and the press roller 42 which rolls on and contacts the heat roller 41 are provided at a position where these rollers sandwich the conveyor path of the copy paper sheet P, with the heat roller 41 pressed by the press roller 42. The contact portions of both rollers 41 and 42 are maintained to have a constant nip width.

The heat roller 41 is rotated and driven in the direction of arrow "a". The press roller 42 rotates in the direction of arrow "b" in response to the rotation of the heat roller 41. The copy paper sheet P passes through the rolling contact portions of the heat roller 41 and the press roller 42 (fixing point), receiving heat from the heat roller 41, so that the developer image T on the copy paper sheet P is fixed to the copy paper sheet P.

A peeling nail 43 for peeling the copy paper sheet P from the heat roller 41, a cleaning member 44 for removing dirt such as toner and paper dust remaining on the heat roller 41, a thermistor 45 for detecting the surface temperature Tr of the heat roller 41, and a mould-releasing agent applicator 46 for applying a mould-releasing agent to the surface of the heat roller 41 are provided in the periphery of the heat roller 41.

A induction heating device 50 is contained as a heat source inside the heat roller 41. The induction heating device 50 comprises a core 51 and a coil 52 attached to the core 51. A high-frequency magnetic field is generated from the coil 52, so that the heat roller 41 is subjected to induction heating by the high-frequency magnetic field.

That is, a high-frequency magnetic field is supplied to the coil 52 from a switching circuit 63 described later, and a high-frequency magnetic field is thereby generated from the coil 52. Eddy currents are caused in the heat roller 41 by the high-frequency magnetic field, and the heat roller 41 autonomously generates heat due to eddy current loss caused by the eddy currents and the resistance of the heat roller 41.

Figure 3:
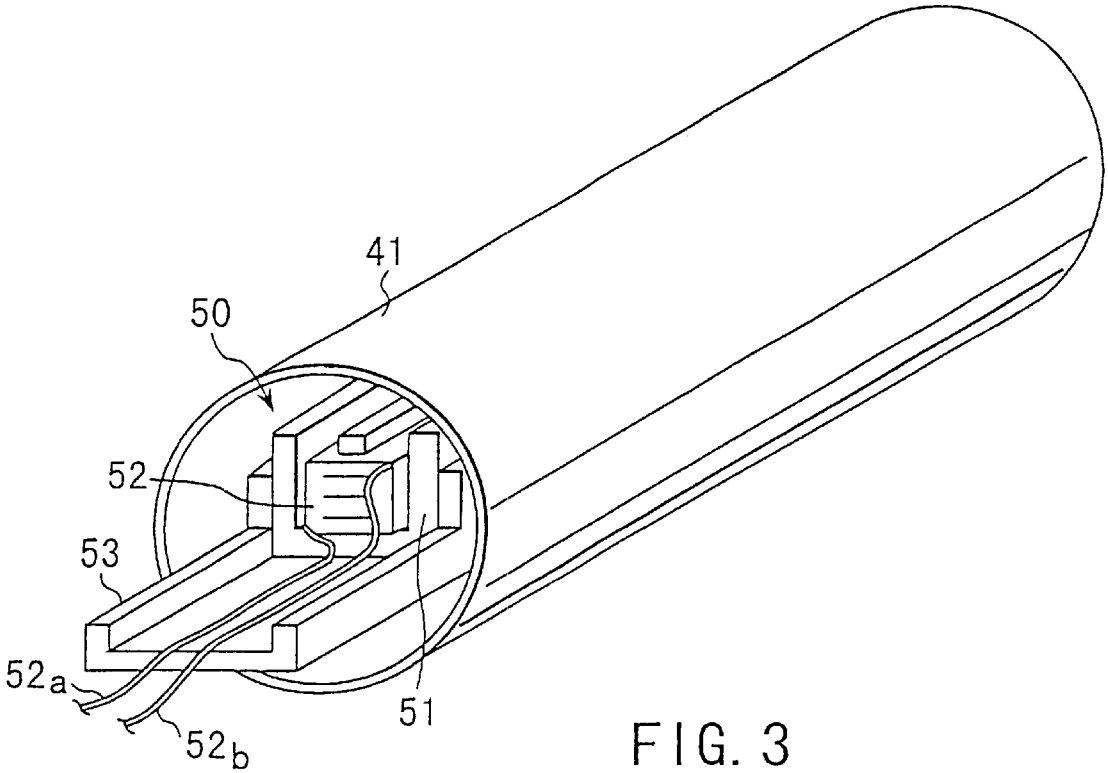
FIG. 3 is a view showing the structure of a main part of the induction heating device.

As shown in FIG. 3, support members 53 are attached respectively to both end parts of the core 51, and the support member 53 is fixed to a fixing metal plate (not shown). These support members 53 supports the induction heating device 50 independently from the heat roller 41.

Figure 4:
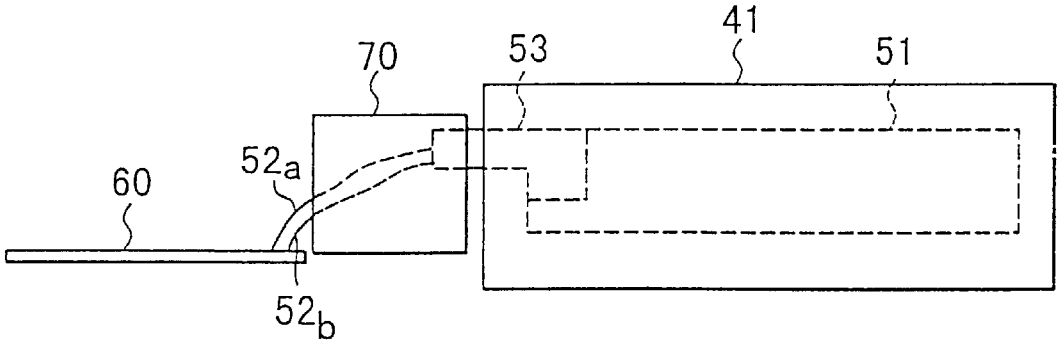
FIG. 4 is a view showing connection between the induction heating device and the circuit board.

As shown in FIG. 4, electric wires (leads) 52*a* and 52*b* are guided from both ends of the coil 52, and the electric wires 52*a* and 52*b* are connected to a circuit board 60 inside the induction heating device 50. Further, a shield member 70 for magnetically shielding the electric wires 52*a* and 52*b* is provided so as to surround the electric wires 52*a* and 52*b*.

Figure 5:
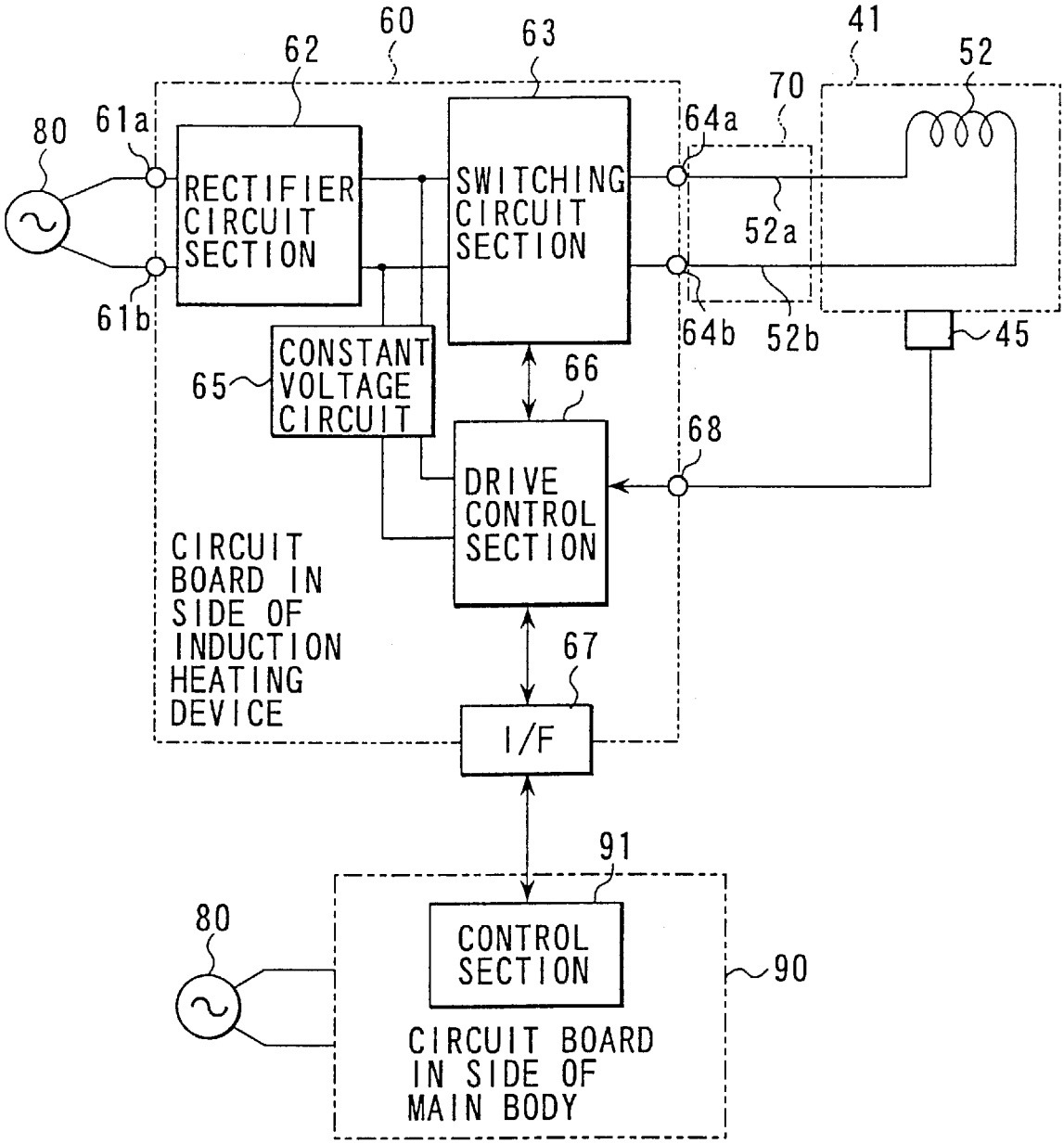
FIG. 5 is a block diagram of the induction heating device and the main body.

As shown in FIG. 5, the circuit board 60 comprises input terminals 61*a* and 61*b* connected to a commercial alternating current power source 80, a rectifier circuit 62 connected to the input terminals 61*a* and 61*b*, a switching circuit 63 connected to an output end of the rectifier circuit 62, output terminals 64*a* and 64*b* connected to an output end of the switching circuit 63, a drive control section 66 connected to an output end of the rectifier circuit 62, an interface circuit 67 for performing data transmission/reception between the drive control section 66 and the control section 91 of the circuit board 90 inside the main body, and an input terminal 68 for receiving temperature detection data form the thermistor 45.

The rectifier circuit 62 rectifies the voltage of the commercial alternating current power source 80. The switching circuit 63 converts the output voltage (direct current voltage) of the rectifier circuit 62 into a high-frequency voltage of a predetermined frequency. The constant voltage circuit section 65 adjusts the output voltage of the constant voltage rectifier circuit 62 to a constant level suitable for operation of the drive control section 66 and outputs it. The drive control section 66 controls drive of the switching circuit 63 in accordance with instructions supplied from the control section 91 of the circuit board inside the main body.

The electric wires 52*a* and 52*b* are connected to the output terminals 64*a* and 64 of the circuit board 60.

The circuit board 90 inside the main body is connected to a commercial power source 80. Although not shown in the figures, respective electric circuit parts are mounted on the circuit board 90 inside the main body.

Figure 6:
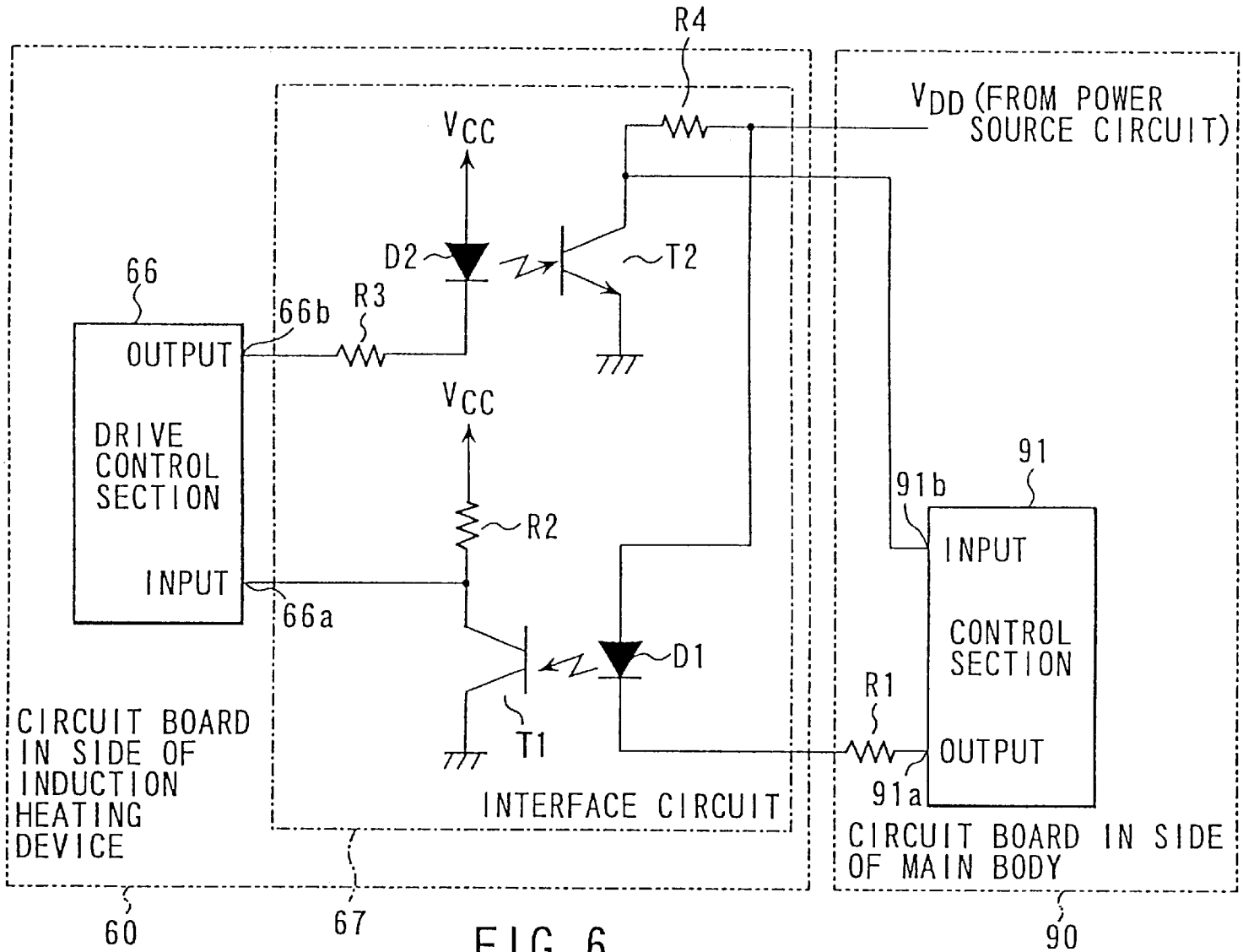
FIG. 6 is a block diagram of the schematic structure of the interface circuit.

As shown in FIG. 6, the interface circuit 67 is constructed of photodiodes D1 and D2, phototransistors T1 and T2, and resistors R2, R3, and R4, which are provided on the circuit board 60 inside the induction heating device 50. The photodiode D1 and the phototransistor T1 construct a photocoupler, as well as the photodiode D2 and the phototransistor T2. As a result of this, the phototransistor T1 is turned on by turning-on of the photodiode D1, and the phototransistor T2 is turned on by turning-on of the photodiode D2.

The anode of the photodiode D1 is supplied with an output signal from the output end 91*a* of the control section 91 of the circuit board 90 in the side of the main body, through the resistor R1 of in the side of the circuit board 90 in the side of the main body. The cathode of the photodiode D1 is applied with a power source voltage VDD from the circuit board 90 inside the main body.

In this manner, the photodiode D1 is turned on and off in correspondence with an output signal from the output end 91*a* of the control section 91.

A serial circuit is constructed by the phototransistor T1 and the resistor R2, and the input end 66*a* of the drive control section 66 is connected to a connecting point between one end side of the resistor R2 and the cathode of the phototransistor T1. A power source voltage VCC is applied to the other end of the resistor R2, and the anode of the phototransistor T1 is grounded.

In this manner, a signal corresponding to ON or OFF of the phototransistor T1 is supplied to the input end 66*a* of the drive control section 66.

The anode of the photodiode D2 is supplied with an output signal from the output end 66*b* of the drive control section 66 through the resistor R3. The cathode of this photodiode D2 is applied with a power source voltage VCC.

In this manner, the photodiode D2 is turned on/off in correspondence with the output signal from the output end 66*b* of the drive control section 66.

A serial circuit is constructed by the phototransistor T2 and the resistor R4, and the input end 91*b* of the control section 91 of the circuit board 90 in the side of the main body is connected to a connecting point between one end side of the resistor R4 and the cathode of the phototransistor T2. A power source voltage VDD from the circuit board 90 inside the main body is applied to the other end of the resistor R4, and the anode of the phototransistor T2 is grounded.

In this manner, a signal corresponding to ON or OFF of the phototransistor T2 is supplied to the input end 91*b* of the control section 91.

According to this structure, a notification signal (L level) of a service mode is outputted from the output end 91*a* of the control section 91. Then, a power source voltage VDD from the circuit board 90 inside the main body is applied to the serial circuit constructed by the photodiode D1 and the resistor R1, so the photodiode D1 is turned on. Upon this turning-on, the phototransistor T1 is turned on, so that the power source voltage VCC of the circuit board 60 of the induction heating device 50 is applied to the serial circuit constructed by the phototransistor T1 and the resistor R2. A notification signal (L level) of the service mode is thus supplied to the input end 66*a* of the drive control section 66.

Based on the supply of this notification signal of the service mode, the drive control section 66 pauses the start-up processing.

Also, the drive control section 66 outputs a status signal from the output end 66*a*. When an error such as abnormal power or the like occurs, a signal of an H level is outputted, although it outputs a signal of an L level normally.

That is, during normal operation, the signal of L level is outputted from the output end 66*a* of the drive control section 66. In this manner, the power voltage VCC in circuit board 60 of the induction heating device 50 is applied to the serial circuit constructed of the photodiode D2 and the resistor R3, so that the photodiode D2 is turned on. By this turning-on, the phototransistor T2 is turned on, so that the power source voltage VDD from the circuit board 90 inside the main body is applied to the serial circuit constructed of the phototransistor T2 and the resistor R4, and a status signal (L level) indicating normality is supplied to the input end 91*b* of the control section 91.

When an error occurs, a signal of H level is outputted from the output end 66*a* of the drive control section 66. Then, the power source voltage VCC of the circuit board 60 of the induction heating device 50 is not applied to the serial circuit constructed by the photodiode D2 and the resistor R3 any more, so that the photodiode D2 is kept turned off. As a result of this, the phototransistor T2 stays turned off, the power source voltage VDD from the circuit board 90 in the side of the main body is not applied to the serial circuit constructed by the phototransistor T2 and the resistor R4 any more, and a status signal indicating abnormality (error) is supplied to the input end 91*b* of the control section 91.

The drive control section 66 described above determines abnormality of the input power source, abnormality of respective circuit parts, and abnormality (disconnection) of the coil.

As has been described above, the operation control section 66 of the circuit board of the induction heating device 50 of the fixing device 40 and the control section of the circuit board 90 in the main body are separated and insulated from each other by the photo-coupler in the interface circuit 67.

In this manner, the power source voltage VCC (100 Volt) of the circuit board 60 and the power source voltage VDD (24 Volt) of the circuit board 90 in the main body can be separated and insulated from each other, so that the power source voltage VCC is prevented from flowing into the circuit board 90 in the main body to cause a failure even when an abnormality occurs in the circuit board 60.

Figure 7:
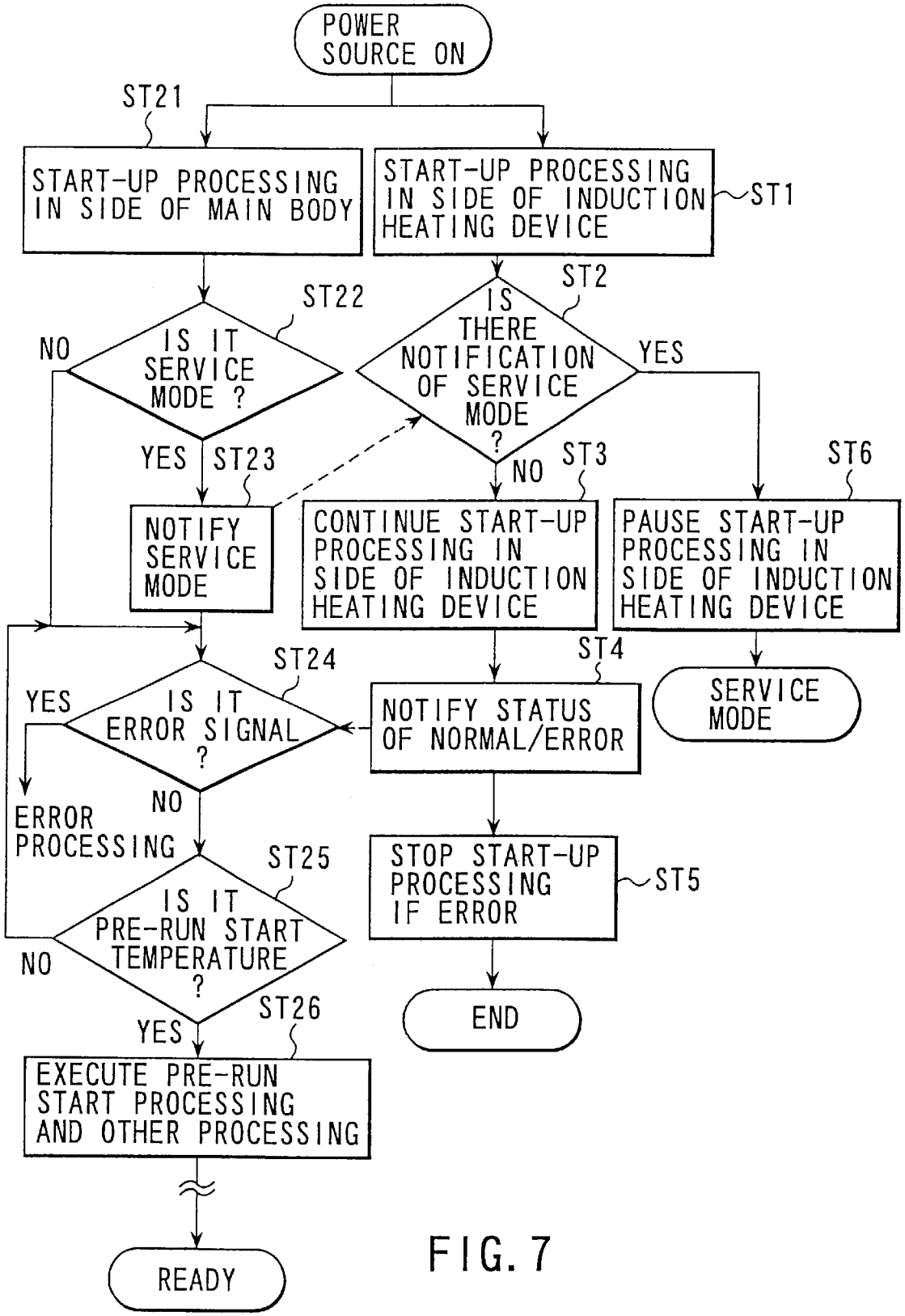
FIG. 7 is a flowchart for explaining start-up processing at the time of turning on the power source in the first embodiment.

Next, start-up processing at the time of turning on the power source will be explained with reference to the flowchart shown in FIG. 7.

That is, when a power switch (not shown) is turned on (at the time of turning on the power), start-up processing made by the control section 91 of the circuit board 90 in the main body and start-up processing made by the operation control section 66 of the circuit board 60 of the induction heating device 50 are carried out in parallel.

At first, the operation control section 66 starts start-up processing, i.e., supply of a high-frequency current to the coil 52 (ST1). Subsequently, the operation control section 66 determines whether or not a notification has been made from the control section 91 (ST2). If there has been no notification about the service mode as a result of the determination, the operation control section 66 continues the start-up processing (ST3).

Also, while normal operation continues without determining an error, the operation control section 66 notifies this status to the control section 91 of the circuit board 90 in the main body (ST4). When an error is determined, the operation control section 66 notifies this status to the circuit board 90 in the side of the main body (ST4). At the time of this error, the operation control section 66 stops the start-up processing, i.e., the supply of the high-frequency current to the coil 52 (ST5).

Also, when notification of the service mode is determined in the above step ST2, the operation control section 66 pauses (stops) the start-up processing, i.e., the supply of the high-frequency current to the coil 52 (ST6).

Also, upon turning-on of the power source, the control section 91 starts start-up processing, i.e., start-up processing for the parts of the fixing device 40 other than the induction heating device 50 (ST21). Also, the control section 91 determines whether the service mode is selected or not (ST22). If the service mode is selected, a notification of the service mode is supplied to the operation control section 66 of the circuit board 60 of the induction heating device 50 (ST23).

Thereafter, the control section 91 performs error processing when an error signal is supplied from the operation control section 66 of the induction heating device 50 (ST24).

Also, the control section 91 determines a pre-run start temperature (ST25) and starts pre-run processing (ST26) when the detection temperature from the thermistor 45 reaches a predetermined temperature while a normal signal is supplied from the operation control section 66 of the induction heating device 50. That is, the control section 91 rotates the heat roller 41 of the fixing device 40 to make uniform the temperature of the entire surface of the heat roller 41. Thereafter, the control section 91 enters in to a ready state at the time when other initial processing ends.

As described above, the control section for driving and controlling the induction heating device of the fixing device and the main-body control section for controlling the entire electric copying machine are individually (independently) included, and start-up processing for the induction heating device is started prior to start-up processing for parts of the electronic copying machine other than the induction heating device.

In this manner, the warm-up time can be shortened. In addition, when the fixing device is in an abnormal state, abnormality can be determined by the control section of the fixing device.

Also, starting of the fixing device is carried out in parallel with the starting of parts in the main body of the electronic copying machine other than the induction heating device.

In addition, in a maintenance mode by service personnel or in recovery from fixing jamming, start-up processing for the fixing device is stopped (paused). As a result of this, start-up processing for the fixing device is stopped depending on the status of the main body of the electronic copying machine because it will be dangerous if the temperature of the fixing device increases, regardless of the main body (safety measure).

In addition, the control section of the fixing device and the control section in the main body of the electronic copying machine are separated and insulated from each other by the photo-coupler in the interface circuit.

Also, the first embodiment described above has been explained with reference to the case where the drive control section of the induction heating device of the fixing device executes start-up processing independently from the control section of the main body of the electronic copying machine. However, a second embodiment, which is not limited to this, can be practiced in a similar manner in the case where the control section of the main body of the electronic copying machine controls start-up processing of the drive control section of the induction heating device of the fixing device.

In this case, the same structures as shown in FIGS. 1 to 6 are used. However, the signal from the output end 91*a* of the control section 91 of the circuit board 90 in the side of the main body is changed to a signal which indicates supply and stop of the high-frequency current to the coil 52. For example, the L level indicates supply of the high-frequency current to the coil 52 while the H level indicates stop of the high-frequency current to the coil 52.

Figure 8:
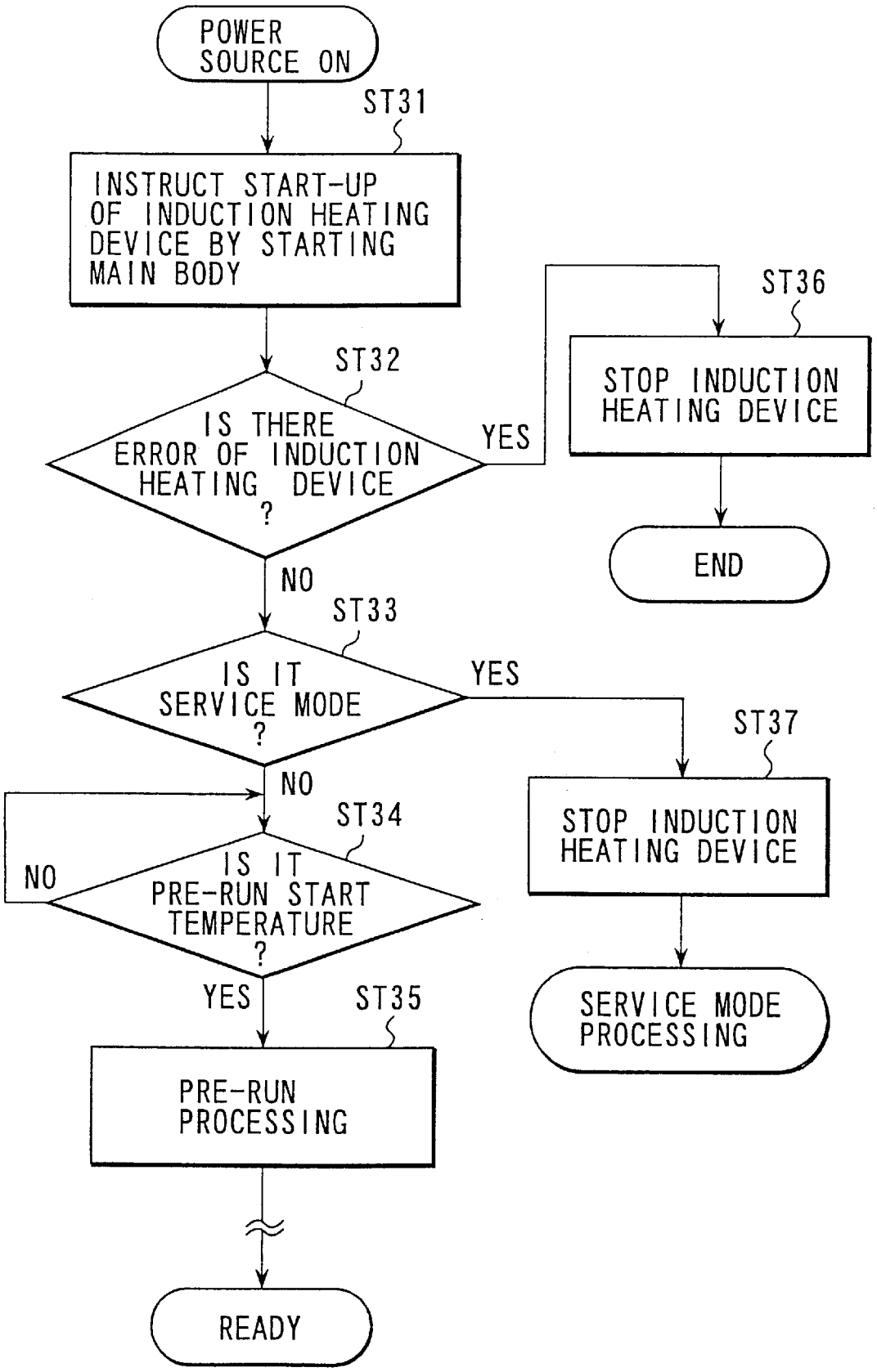
FIG. 8 is a flowchart for explaining start-up processing at the time of turning on the power source in the second embodiment.

Next, start-up processing at the time of turning on the power will be explained with reference to the flowchart shown in FIG. 8.

That is, when a power source switch (not shown) is turned on, start-up processing by the control section 91 of the circuit board 90 in the main body, i.e., start-up processing for parts other than the induction heating device 50 of the fixing device 40 is started, and the operation control section 66 of the circuit board 60 of the induction heating device 50 is notified of supply of a high-frequency current to the coil 52 (ST31).

In this manner, upon the notification, the operation control section 66 starts start-up processing, i.e., supply of the high-frequency current to the coil 52.

Whether operation continues normally or an error is detected this operation control section 66 notifies this status to the control section 91 of the circuit board 90 in the main body.

If no error signal is supplied from the operation control section 66 of the induction heating device 50 (ST32) and if the service mode is not selected (ST33), the control section 91 determines a pre-run start temperature (ST34) and starts pre-run processing (ST35) when the detection temperature from the thermistor 45 reaches a predetermined temperature. That is the control section 91 rotates the heat roller 41 of the fixing device 40 to make uniform the temperature of the entire surface of the heat roller 41. Thereafter, the control section 91 enters into a ready state at the time when other initial processing ends.

When an error signal is supplied from the operation control section 66 of the induction heating device 50 through the step ST32 described above, the control section 91 performs error processing and notifies stop of the high-frequency current to the coil 52, to the operation control section 66 of the circuit board 60 of the induction heating device 50 (ST36).

In this manner, the operation control section 66 stops start-up processing, i.e., supply of the high-frequency current to the coil 52.

Also, when the service mode is selected through the step ST33 described above, the control section 91 notifies stop of the high-frequency current to the coil 52, to the operation control section 66 of the circuit board 60 of the induction heating device 50 (ST37), and performs processing of the service mode.

In this manner, the operation control section 66 stops start-up processing, i.e. supply of the high-frequency current to the coil 52.

The present invention is applicable to any device in a similar manner as long as the device has a fixing device in which a high-frequency current is supplied to a coil from a high-frequency generation circuit so that a high-frequency magnetic field is generated from the coil to achieve induction heating.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus having a fixing device which includes a coil in a heat roller and lets the heat roller generate a high-frequency magnetic field thereby to generate eddy currents in the heat roller, and which fixes a developer image on to a recording medium by autonomous heat generation of the heat roller, based on eddy current loss, comprising:

drive means for driving the fixing device;

execution means for executing preceding start-up processing, to start drive of the fixing device by the drive means prior to other parts;

setting means for setting a service mode for performing maintenance on the image forming apparatus; and stop means for stopping the preceding start-up processing by the execution means, when the service mode is set by the setting means.

* * * * *